US006361118B1

(12) United States Patent
Melgarejo et al.

(10) Patent No.: US 6,361,118 B1
(45) Date of Patent: Mar. 26, 2002

(54) HINGE MECHANISM FOR A TRUNK SUPPORT APPARATUS

(75) Inventors: Mauricio Melgarejo; Alejandro Melgarejo, both of Simi Valley, CA (US)

(73) Assignee: Freedom Designs, Inc., Simi Valley, CA (US)

( * ) Notice: Subject to any disclaimer, the term of this patent is extended or adjusted under 35 U.S.C. 154(b) by 0 days.

(21) Appl. No.: 09/553,432

(22) Filed: Apr. 19, 2000

Related U.S. Application Data

(60) Provisional application No. 60/129,978, filed on Apr. 19, 1999.

(51) Int. Cl.[7] ..... A47C 7/54

(52) U.S. Cl. ..... 297/488; 297/284.9; 297/411.31; 16/324; 16/326

(58) Field of Search ..... 297/284.9, 411.31, 297/411.35, 411.38, 467, 487, 488, 464; 16/324, 326

(56) References Cited

U.S. PATENT DOCUMENTS 998,584 A * 7/1911 Martin ..... 16/326 X
1,527,754 A * 2/1925 Simon ..... 297/464
3,012,270 A * 12/1961 Reid ..... 16/326
3,704,910 A * 12/1972 Willcott ..... 297/DIG. 4 X
4,065,179 A * 12/1977 Takasaki ..... 297/DIG. 4 X
4,073,537 A * 2/1978 Hammersburg .... 297/DIG. 4 X
5,678,798 A * 10/1997 Little ..... 16/324 X

* cited by examiner

*Primary Examiner*—Peter R. Brown
(74) *Attorney, Agent, or Firm*—Oppenheimer Wolff & Donnelly LLP

(57) ABSTRACT

The present invention is a support arm mechanism that is simpler, more durable and more reliable in use than support arm mechanisms of the prior art. The invention also relates to an improved hinge that can be used in a trunk support arm mechanism, and in other applications. One embodiment of the present invention is a locking trunk support hinge that is convenient to lock and unlock. For example, the hinge can have a lock with a front hinge portion and a rear hinge portion. A locking member, having a locking head and an angled lever, is rotatably mounted to one of hinge portions, and a locking channel extends in the other one. The hinge has a locked mode in which the locking head is engaged in the locking channel and the hinge cannot be opened, and an unlocked mode in which the locking head is not engaged in the locking channel and the hinge can be swung open. The locking mechanism may have a compression spring that biases the locking head into the locked mode when the front and rear hinge portions are aligned.

19 Claims, 7 Drawing Sheets

FIG. 6
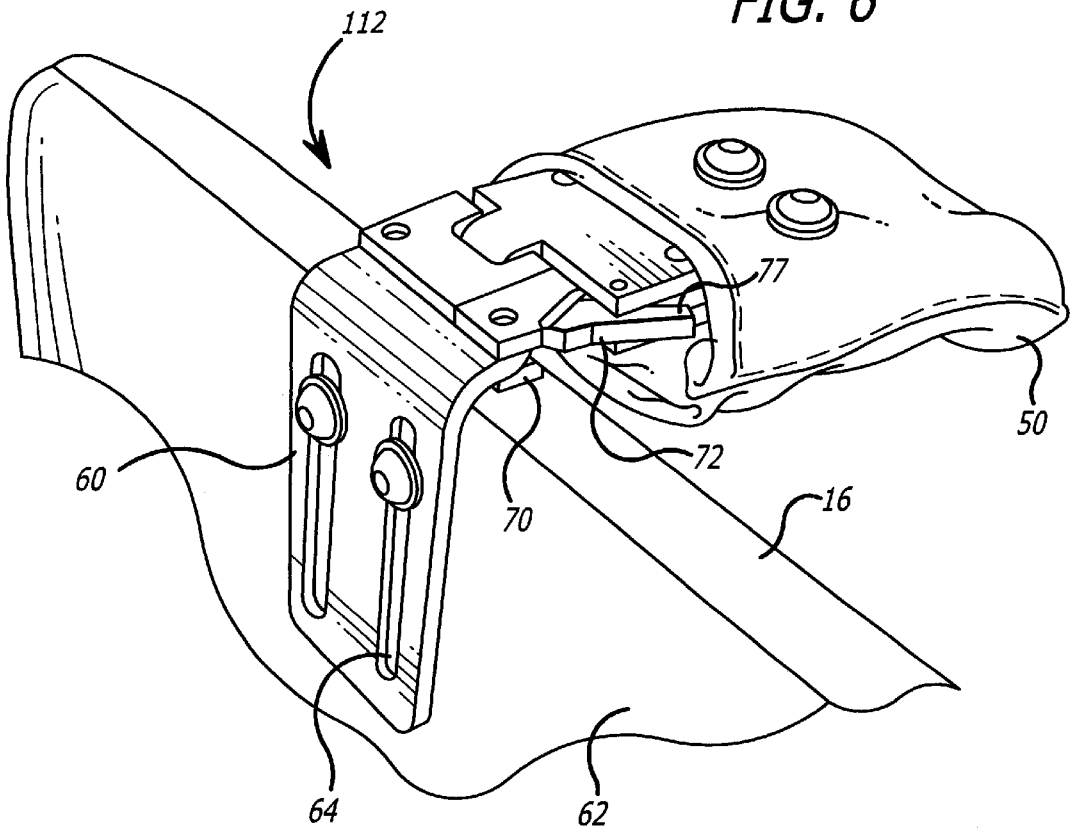
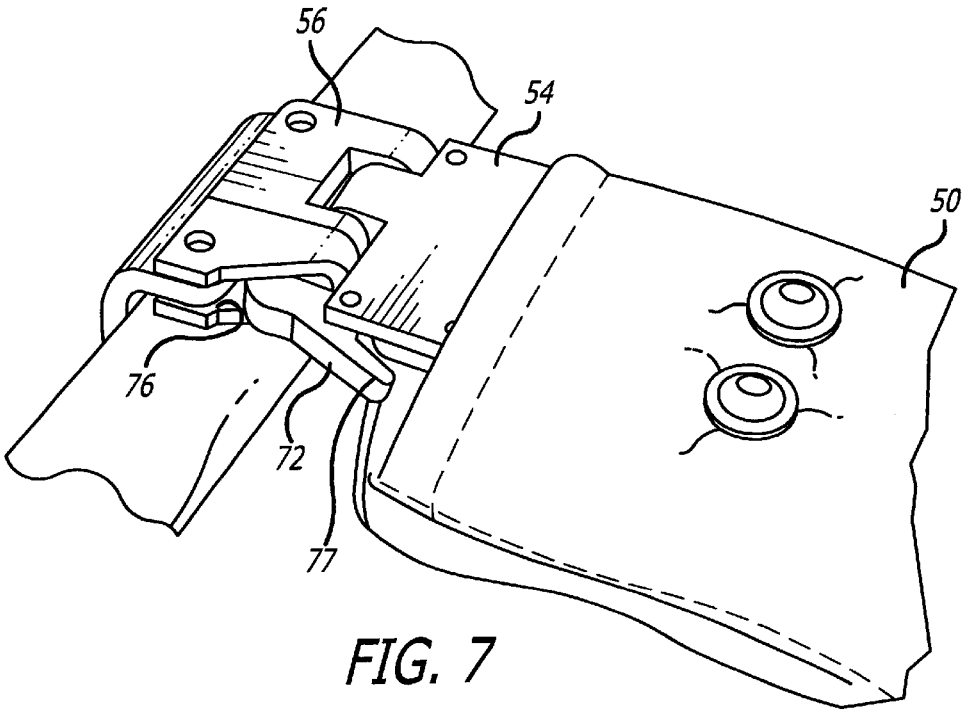
FIG. 7

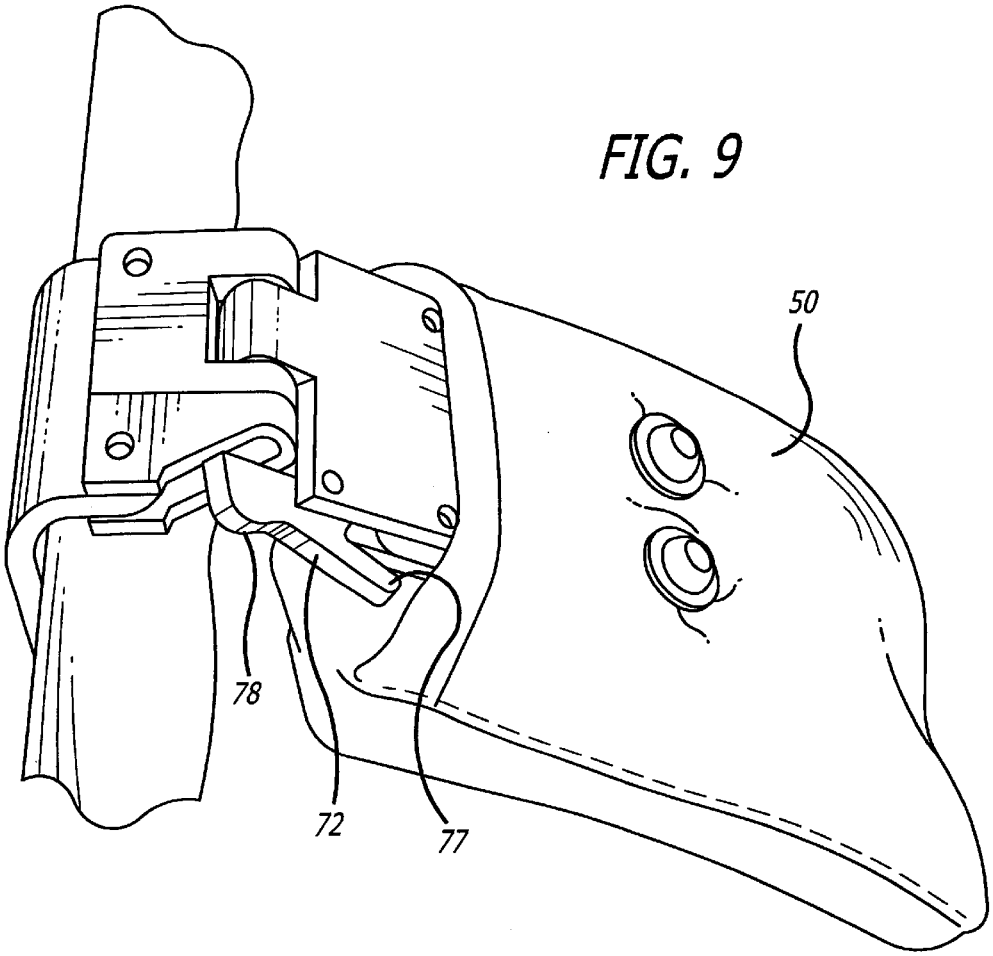
FIG. 9
FIG. 10
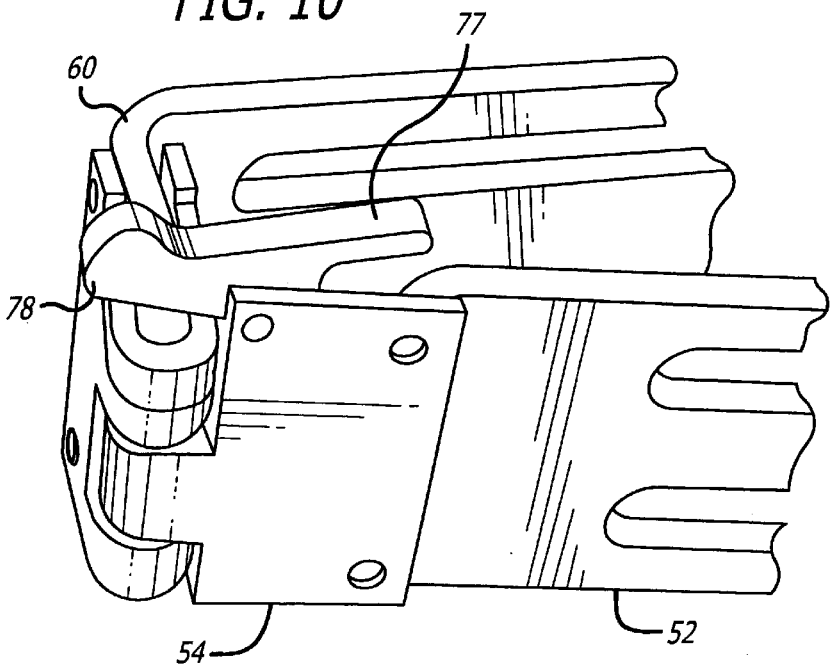

56
54
52
60
78
77

16
56

HINGE MECHANISM FOR A TRUNK SUPPORT APPARATUS

Note: This nonprovisional application claims the benefit of U.S. Provisional Patent Application Serial No. 60/129,978, which was filed on Apr. 19, 1999 and was entitled "Hinge Mechanism For a Trunk Support Apparatus."

I. BACKGROUND OF THE INVENTION a. Field of the Invention

The present invention relates to support mechanisms in seats and, in particular, to a convenient trunk support mechanism for a wheelchair.

b. Prior Art

By way of introduction, FIG. 1 illustrates a wheelchair seat 10 according to the present invention, on which is mounted a trunk support mechanism 12. The trunk support mechanism 12 serves to limit the lateral range of motion of the patient, so that his or her torso does not shift to the left or right within the wheelchair. The seat 10 of FIG. 1 is a prototype that is presented here strictly for the purpose of illustration, and it has a trunk support mechanism on only one side of the seat. In practice, the respective trunk support mechanisms will be mounted on both the left and right sides of the seat.

Continuing our introduction, the seat 10 of FIG. 1 has a bottom cushion 14 and a back seat cushion 16. A pelvic stabilizer mechanism 18 serves to retain the patient's pelvis within the chair. A suitable pelvic stabilizer is described in a co-pending patent application filed concurrently herewith entitled "Pelvic Stabilizer Mechanism for a Wheelchair" and in U.S. Provisional Patent Application No. 60/130,046, both of which are incorporated by reference herein. In practice, the seat 10 will be mounted on a base having wheels and other components that are typical of a wheelchair.

FIG. 2 illustrates a prior art trunk support mechanism 20 that is awkward to use. The mechanism includes a padded trunk support arm 22. The mechanism is mounted on the rear of the back seat cushion 24 with a mounting mechanism 26. The trunk support mechanism 20 has a hinge 28, with a rear hinge portion 30 and a front hinge portion 32. The trunk support mechanism is in a locked position in FIG. 2, but it can be disengaged from the locked position so that the support arm 22 can swing outwardly and away from the patient. The arm is normally swung outwardly when the patient is being put into or removed from the seat, or when the patient's position must be changed.

The prior art mechanism of FIG. 2 is cumbersome to use. The user must lift up on the front hinge portion 32 at a specific point 34 (FIG. 3) in order to disengage a spring-loaded pin (not shown) in the upper portion 36 of rear hinge portion 30 from engagement with a receptacle 38 (FIG. 4) that has an indentation to receive the spring loaded pin. The mechanism is awkward to use because the user must push up at exactly point 34, or the rear and front portions of the hinge will not disengage from one another, and the hinge will not rotate. Even when the user does push up at the proper point 34, the patient must be moved off to one side of the seat, so that he or she is not leaning against the trunk support mechanism 20. Otherwise, the weight of the patient prevents the user from unlocking the support arm and, again, the arm will not unlock.

U.S. Pat. No. 5,678,798 to Little discloses a swing-away support bracket having a housing, an axle mounted for rotation in the housing, a toggle with a protrusion, and a tapered recess in the axle to receive the protrusion. To lock the swing-away support bracket, the user engages the protrusion into the axle. The arrangement is inconvenient, because the toggle is located within a narrow recess in the housing. The lock is also weak, because the protrusion on the toggle is small, with only a small portion of the toggle engaging with the tapered recess.

II. SUMMARY OF THE INVENTION

Broadly defined, the present invention is a support arm mechanism that is simpler and/or more reliable in use than support arm mechanisms of the prior art. The invention also relates to an improved hinge that can be used in a trunk support arm mechanism, and in other applications.

One embodiment of the present invention is a locking trunk support hinge that is convenient to lock and unlock. For example, the hinge can have a lock with a front hinge portion and a rear hinge portion. A locking member, having a locking head and a lever, is rotatably mounted to one of hinge portions, and a locking channel extends in the other one. The hinge has a locked mode in which the locking head is engaged in the locking channel and the hinge cannot be swung, and an unlocked mode in which the locking head is not engaged in the locking channel and the hinge can be swung open. The locking mechanism can have a compression spring that biases the locking head into the locked mode when the front and rear hinge portions are aligned.

In accordance with a particular embodiment of the present invention, a durable locking mechanism for a wheel chair trunk support apparatus has a back bracket, a front bracket, and a hinge piece that extends from the back bracket toward the front bracket. The hinge piece has a top and a bottom, with the bottom including an elongated open channel defined by first and second walls. A locking member is rotatably mounted on the front bracket. The locking member has an angled lever and an elongated locking head that is configured to fit within the open channel of the hinge piece. The lever extends downwardly from the front bracket, and the locking head extends forwardly. The locking mechanism has a first, locked mode in which the locking head is situated within the open channel and in between the first and second walls, and a second, unlocked mode in which the locking head is situated outside of the open channel. The locking mechanism may also include a compression spring mounted within the hinge piece and adjacent to the locking member, to maintain the locking head in the open channel when the locking mechanism is in the first, locked mode.

Particular embodiments may incorporate various features. For example, the locking head may be at least ½ inch long. The front and rear brackets and the hinge piece may be ½" or less thick in order to limit the bulk of the support. In the locked position, the entire length of locking head may be engaged in the locking channel. The lever of the locking member may extend at an angle of between about 10 degrees and 60 degrees, and preferably from between about 20 degrees and 45 degrees, downwardly from the front bracket. This angled lever provides a convenient means of engaging the locking member to unlock the hinge mechanism. The lever and hinge member are typically metal, and portions of the mechanism may be made from steel for particular strength and durability. The hinge piece may be separate from but attached to the front bracket, or it may be unitary with the front bracket. The trunk support may be one component in a convenient system for releasably retaining a person in the wheelchair. Such a system can include a wheelchair seat, a trunk support mechanism as described above, and a pelvic support mechanism as described in a co-pending patent application filed concurrently herewith entitled "Pelvic Stabilizer Mechanism for a Wheelchair" and in U.S. Provisional Patent Application No. 60/130,046.

Various other objects and features of the invention will become apparent in the Detailed Description below, in the drawings and in the claims.

III. BRIEF DESCRIPTION OF THE DRAWINGS

Figure 1:
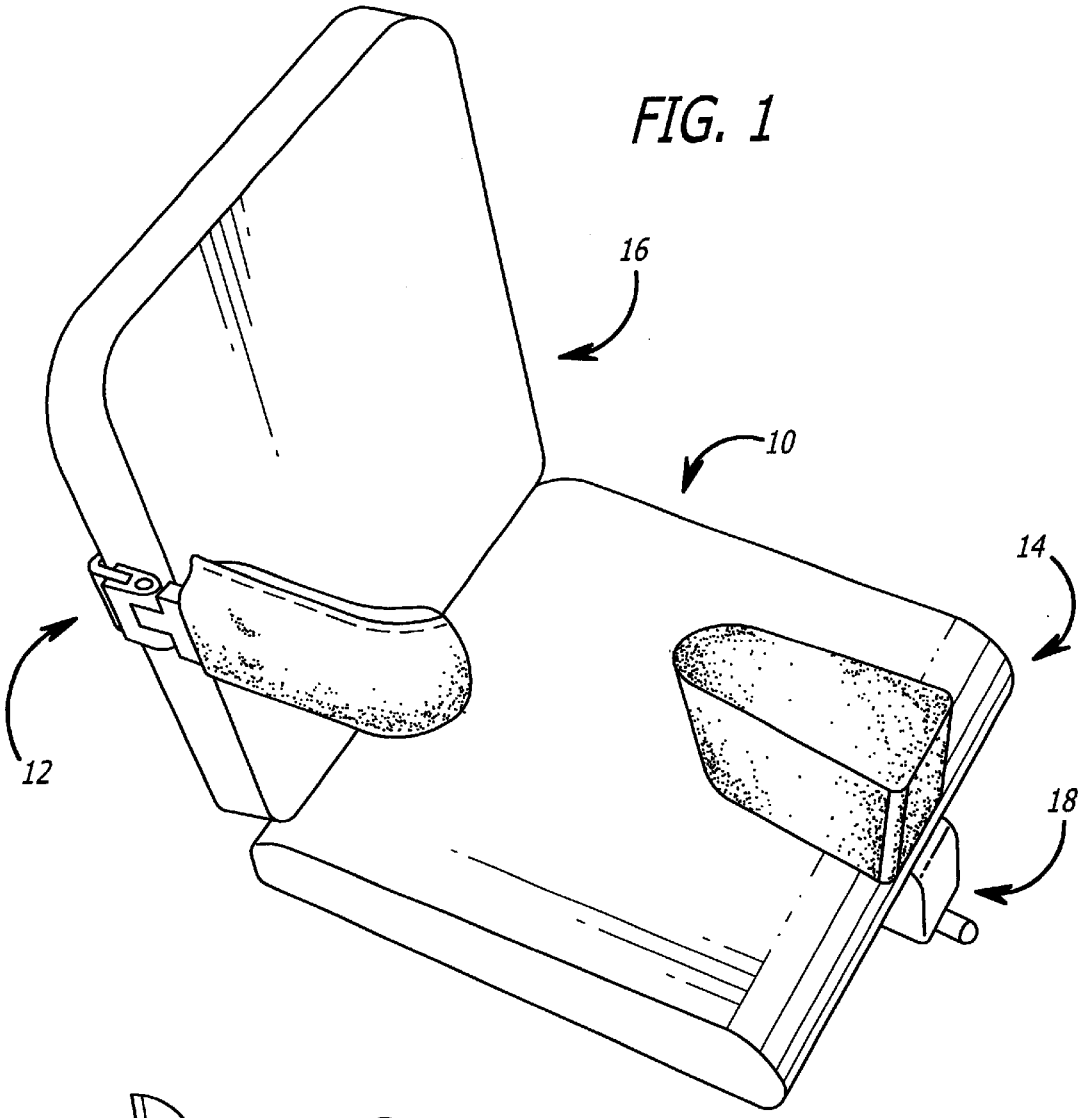
FIG. 1 is a perspective view of a prototype wheelchair seat fitted with a trunk support assembly and a pelvic stabilizer mechanism.
Figure 2:
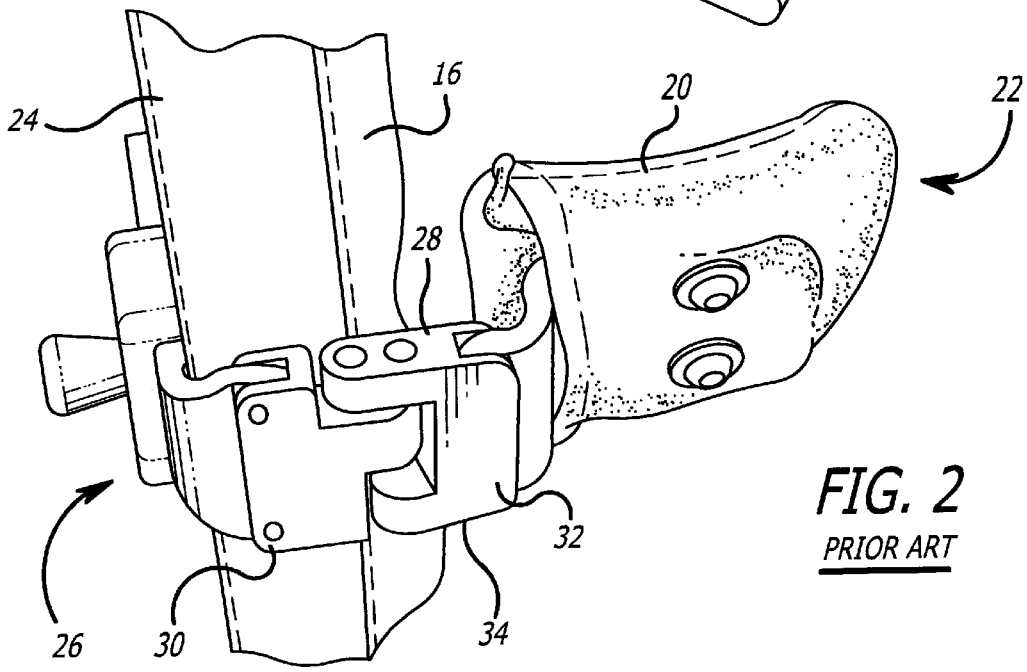
FIG. 2 PRIOR ART
FIG. 2 is a detail view of a prior art trunk support assembly.
Figure 3:
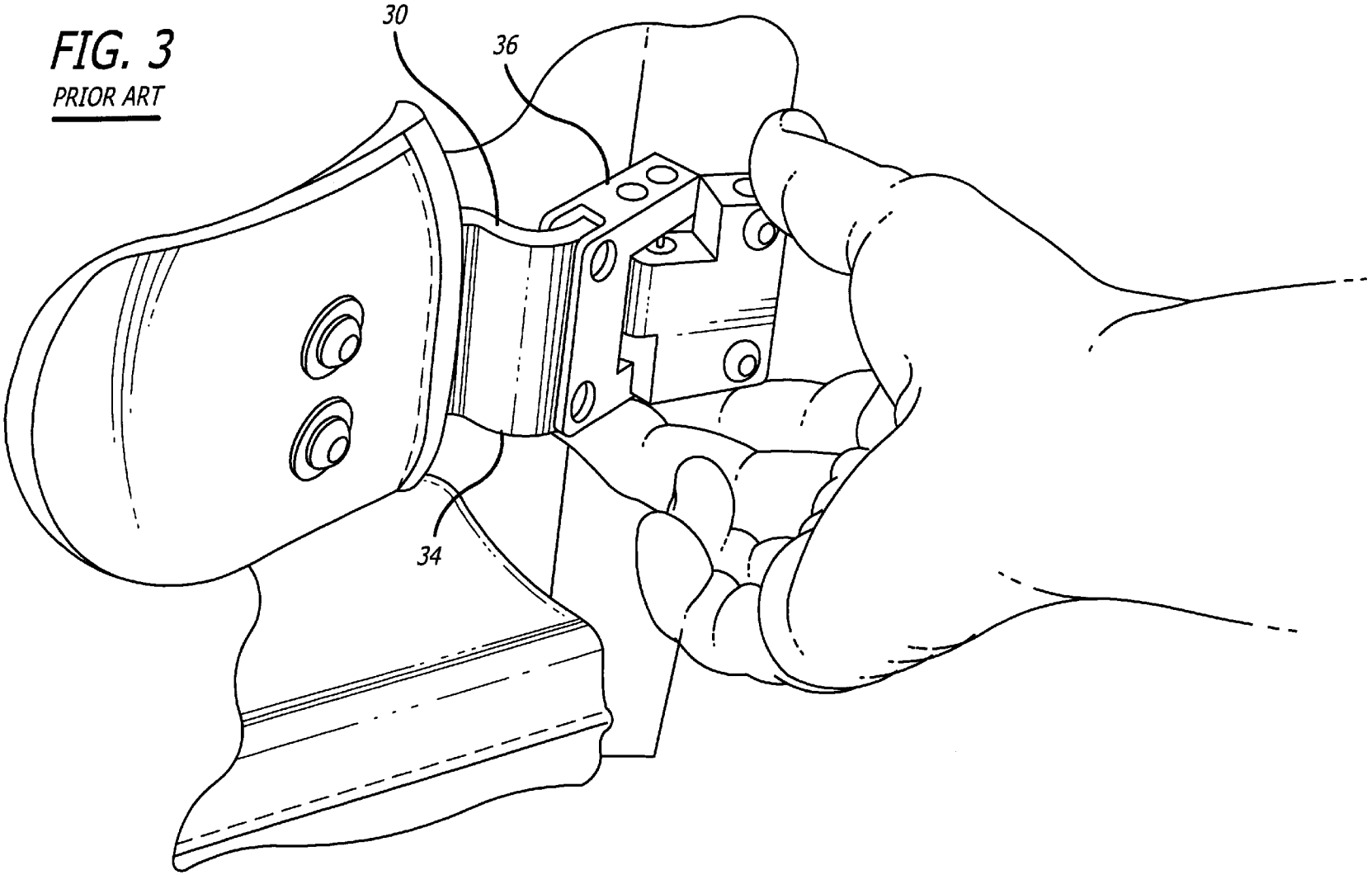
FIG. 3 PRIOR ART
FIG. 3 is a detail view of a user adjusting the prior art trunk support assembly of FIG. 2.
Figure 4:
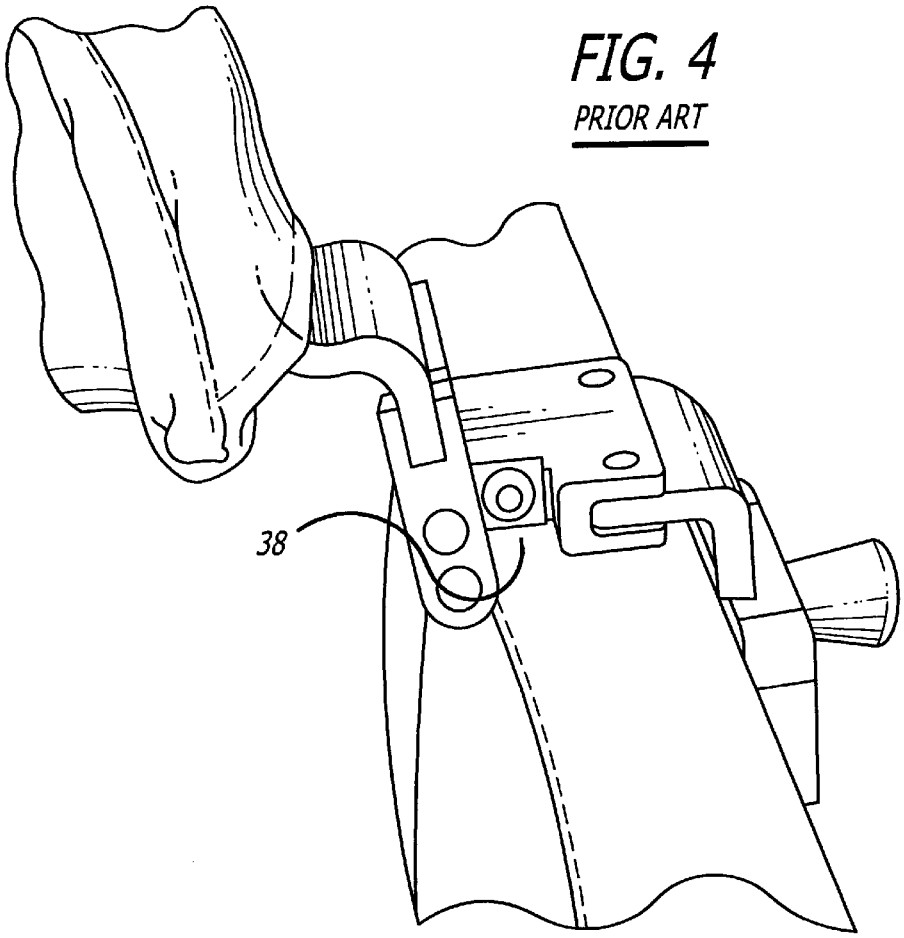
FIG. 4 PRIOR ART
FIG. 4 is top perspective view of the prior art trunk support assembly of FIG. 2, in the open position.
Figure 5:
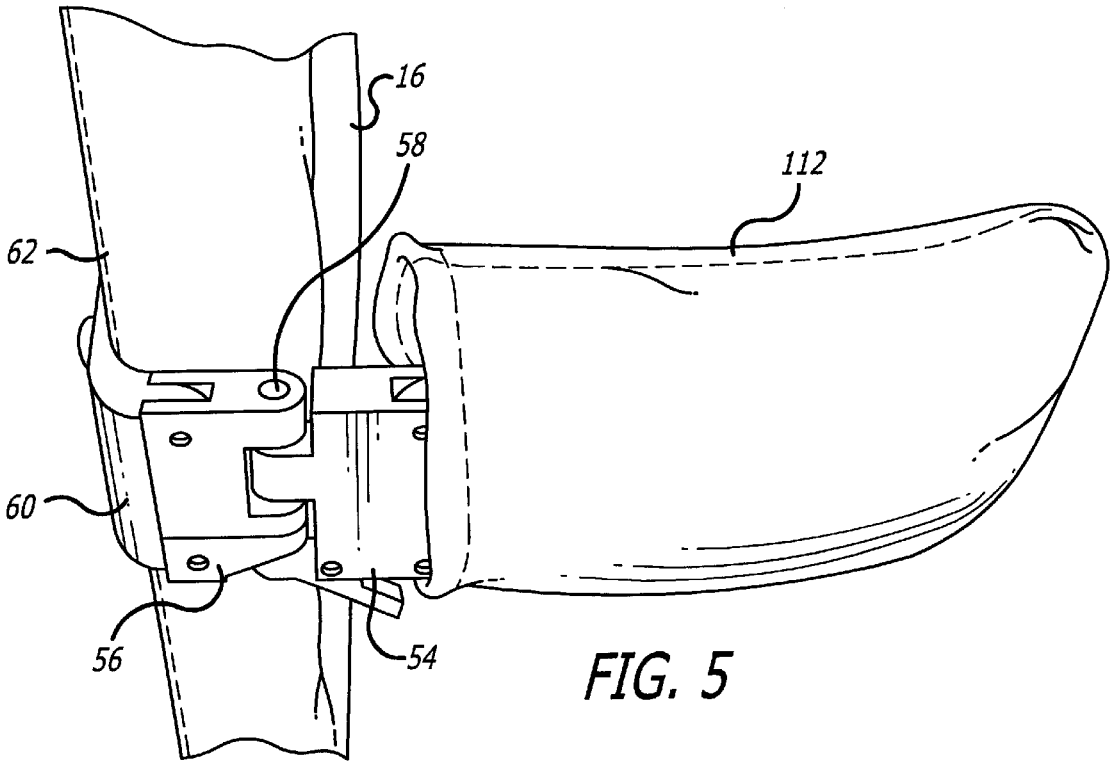
FIG. 5 is a detail view of one embodiment of a trunk support assembly according to the present invention.
Figure 8:
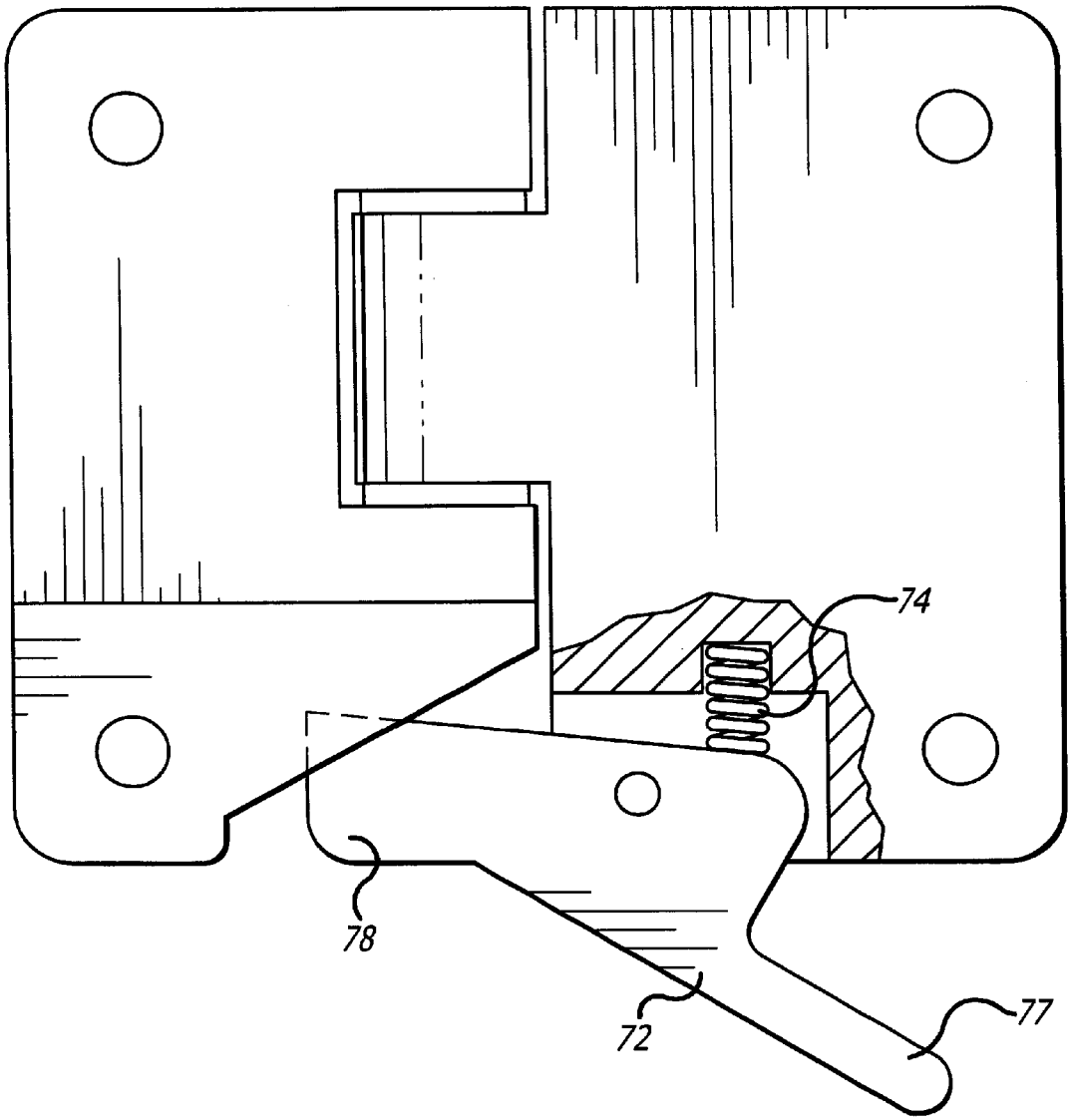
Figure 11:
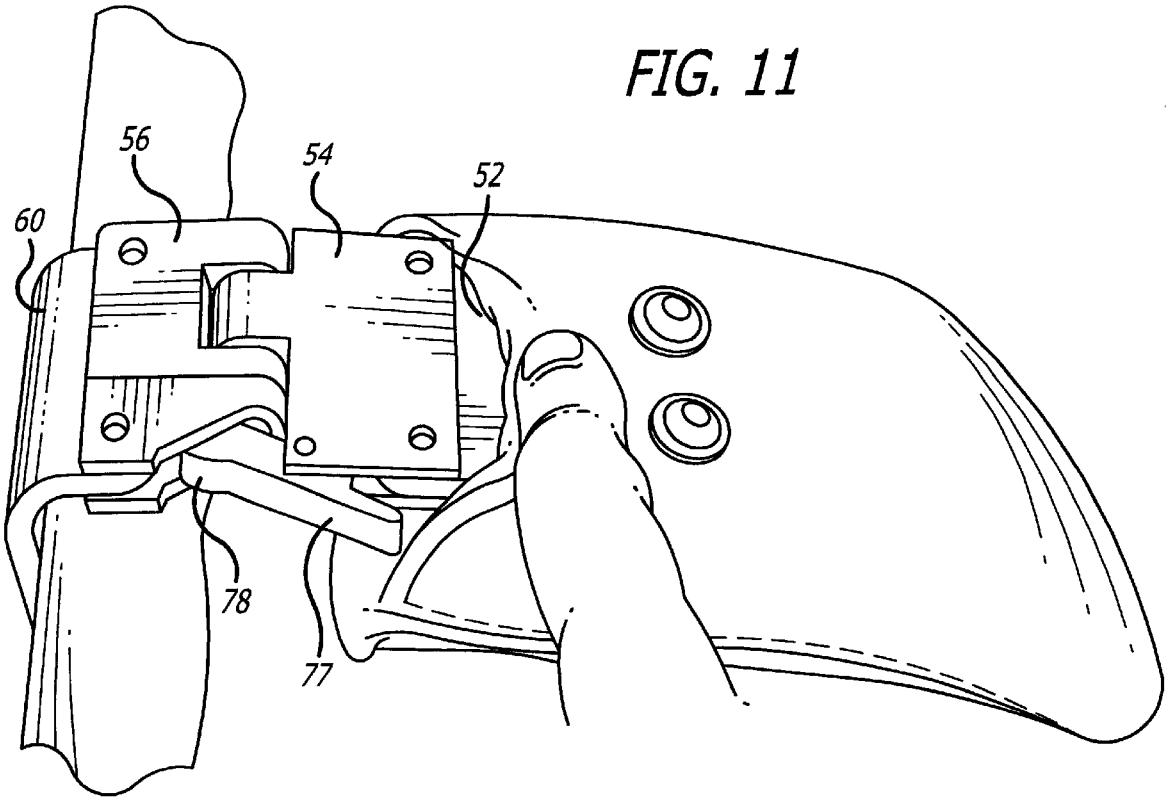
Figure 12:
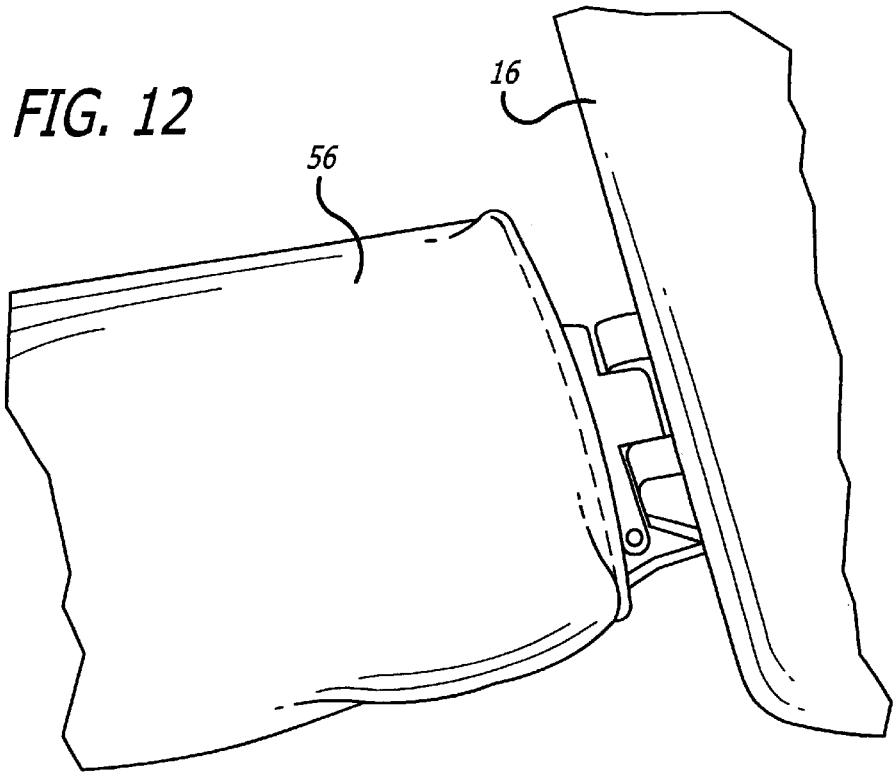

FIG. 6 a bottom perspective view of the trunk support assembly of FIG. 5 in a locked mode;

FIG. 7 is a another bottom perspective view of the trunk support assembly of FIG. 5 in a locked position, showing a compression spring mounted within the trunk support assembly;

FIG. 8 is a side-detail view with a cut-away portion illustrating the locking member 72 and a biasing ring 74 that biases the locking member into a locked position;

FIG. 9 is a bottom perspective view of the trunk support assembly of FIG. 5 in a swing mode, after the lever has been disengaged and the padded arm is free to rotate inwardly or outwardly, FIG. 10 is a detail view of the trunk support assembly of FIG. 5 with the padding removed and showing,the channel into which the lever engages;

FIG. 11 is a bottom perspective view of the trunk support assembly of FIG. 5 with a portion of the padding pushed back to show the hinge attached to the plate about which the padding extends; and FIG. 12 is an interior perspective view of the trunk support assembly of FIG. 5 in which the support is in a locked mode.

IV. DETAILED DESCRIPTION OF A PREFERRED EMBODIMENT

FIG. 5 illustrates a presently preferred embodiment of the present invention. A trunk support mechanism 112 is mounted on a wheelchair seat 10. The trunk support mechanism 112 serves to limit the lateral range of motion of the patient, so that his or her torso does not shift to the left or right within the wheelchair. There is another trunk support mechanism (not shown) on the opposite side of the seat, such that the pair of trunk support mechanisms serve together to laterally secure the patient within the seat.

Returning to FIG. 5, the trunk support mechanism 112 includes a padded portion 50 that is mounted on a plate or bracket 52 (FIGS. 9 and 10), which is in turn fixedly mounted on a forward hinge portion 54. The forward hinge portion 54 is rotatably mounted onto a rear hinge portion 56. A pin 58 interconnects forward and rear hinge portions 54 and 56, respectively, such that forward hinge portion 54 can rotate relative to the rear portion 56 when the hinge is not in a locked mode.

The rear hinge portion 56 is mounted onto a back plate 60 (see also FIG. 6) that is mounted onto the rear 62 of back seat cushion 16 with bolts and/or other conventional fastening means. In the presently preferred embodiment, the back plate 60 includes one or more mounting slots 64 (FIG. 6) or other known arrangements to permit adjusting the lateral position of the trunk support mechanisms. That is, for a particular user, the respective trunk support mechanisms can be mounted to extend farther out from the side of the chair than is shown in the figures.

A feature of the preferred embodiment of the present invention is that the profile of the trunk support hinge is quite narrow, due to the locking mechanism 70 that FIGS. 6–9 illustrate. The locking mechanism 70 includes a pivoting locking member 72, a compression spring 74 and a channel 76. The pivoting locking member 72 has an angled lever portion 77 and a locking head 78. The locking member 72 is rotatably mounted on the forward hinge member 54, as FIG. 8 illustrates. When the hinge is in the locked mode of FIGS. 6 and 7, the locking head 78 is engaged in the locking channel 76. That is, the locking head 78 extends from the forward hinge portion across and into the locking channel 76. The locking head 78 then prevents hinge from rotating.

When the user pushes the lever 72 back against the compression spring to lift the locking head 78 out of the locking channel, the hinge is then free to rotate to an open position. In a presently preferred embodiment, the compression spring has a free length of 0.75 inches, has an outer diameter of 0.240 inches and is made with wire having a thickness of 0.032 inches. Of course, these dimensions are merely examples, and various other springs can be used with similar effect.

FIG. 9 illustrates the locking head 78 having been removed from the locking channel 76, and the padded portion 50 having been rotated inwardly toward the interior surface of the back seat cushion 16. In practice, the user will normally rotate the padded portion 50 outwardly, in the opposite direction of FIG. 9, in order to either enable the patient to be removed from the seat or to allow the patient to enter the seat. FIG. 9 illustrates the padded portion 50 having been rotated inwardly solely for the purpose of illustrating the locking mechanism.

FIG. 10 further illustrates the trunk support mechanism, as it has been removed from the wheelchair and with the padding removed. FIG. 10 particularly illustrates the locking channel 76, into which the locking head 78 extends. FIG. 11 illustrates the junction between the front plate 52, which can also be called the forward plate or bracket, and the forward hinge portion 54. The two can be interconnected with screws, rivets, or other standard fastening means.

The presently preferred embodiment is generally made with aluminum components, which are lightweight, and a stainless steal lever 72. The forward and rear aluminum plates are typically anodized. The hinge is therefore lightweight and, because of its compact design, has a maximum thickness of only ½". The hinge stays out of the way of the patient, as compared to bulkier prior art designs.

The foregoing has described a presently preferred embodiment of the invention. However, it should be understood that this is just one example of the present invention. Various changes can be made within the scope of the invention. As one example, the locking mechanism can go on the top of the hinge rather than on the bottom. Consequently, the present invention is not limited by the preferred embodiment.

What is claimed is:

1. A durable locking mechanism for a wheel chair trunk support apparatus comprising:

a back bracket;

a front bracket;

a hinge piece extending from the back bracket toward the front bracket, the hinge piece having a top and a bottom, said bottom including an elongated open channel defined by first and second walls;

a locking member rotatably mounted on said front bracket, said locking member having a lever and an elongated locking head that is configured to fit within said open channel of said hinge piece, said lever extending downwardly from said front bracket, said locking head extending forwardly;

wherein the locking mechanism has a first, locked mode in which the locking head is situated within the open channel and in between said first and second walls, and a second, unlocked mode in which the locking head is situated outside of the open channel;

said locking mechanism further comprising a compression spring mounted within said hinge piece and adjacent to said locking member, to maintain said locking head in said open channel when the locking mechanism is in the first, locked mode.

2. A durable locking mechanism as defined in claim 1, wherein said locking head is at least ½ inch long.

3. A durable locking mechanism as defined in claim 1, wherein in the locked position, the entire length of locking head is engaged in the locking channel.

4. A durable locking mechanism as defined in claim 1, wherein said lever extends at an angle between 20 degrees and 45 degrees downwardly from the front bracket.

5. A durable locking mechanism as defined in claim 1, wherein said lever and hinge member are metal.

6. A durable locking mechanism as defined in claim 1, wherein said lever and said walls defining said channel are steel.

7. A durable locking mechanism as defined in claim 1, wherein a pad is mounted on the front bracket for padding the trunk of the body to be supported.

8. A durable locking mechanism as defined in claim 7, wherein said front bracket includes at least one elongated mounting aperature for adjustably mounting the pad onto the front bracket.

9. A durable locking mechanism as defined in claim 1, wherein said hinge piece is separate from but attached to the front bracket.

10. A durable locking mechanism as defined in claim 1, wherein said hinge piece is unitary with said front bracket.

11. A durable locking mechanism for a wheel chair trunk support apparatus comprising:

a first bracket;

a second bracket;

a hinge piece extending from the first bracket toward the second bracket, the hinge piece having a bottom and a downwardly facing open channel in said bottom;

a locking member rotatably mounted on said second bracket, said locking member having a lever and a locking head that is configured to fit within said open channel of said hinge piece said lever extending downwardly from said second bracket, said locking head extending forwardly;

wherein the locking mechanism has a first, locked mode in which the locking head is situated within the downwardly facing open channel of said hinge piece, and a second, unlocked mode in which the locking head is situated outside of the open channel.

12. A locking mechanism as defined in claim 11, wherein said locking head is at least ½ inch long.

13. A locking mechanism as defined in claim 11, wherein in the locked position, the entire length of locking head is engaged in the locking channel.

14. A locking mechanism as defined in claim 11, wherein said lever extends at an angle between 20 degrees and 45 degrees downwardly from the front bracket.

15. A locking mechanism as defined in claim 11, wherein said lever and hinge member are metal.

16. A locking mechanism as defined in claim 11, wherein said lever and hinge member comprise steel.

17. A locking mechanism as defined in claim 11, wherein a pad is mounted on the second bracket for padding the trunk of the body.

18. A locking mechanism as defined in claim 17, wherein said second bracket includes at least one elongated mounting aperture for adjustably mounting the pad onto the second bracket.

19. A locking mechanism as defined in claim 11, wherein said hinge piece is unitary with said second bracket.

* * * * *